US009260267B2

(12) United States Patent
Flynn et al.

(10) Patent No.: US 9,260,267 B2
(45) Date of Patent: Feb. 16, 2016

(54) PAPER DUST REMOVAL DEVICE

(71) Applicant: Xerox Corporation, Norwalk, CT (US)

(72) Inventors: Neil Flynn, Bedfordshire (GB); John Saunders, Hertfordshire (GB); Allan McIver, Hertfordshire (GB); Craig Edwards, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/283,355

(22) Filed: May 21, 2014

(65) Prior Publication Data

US 2015/0336762 A1 Nov. 26, 2015

(51) Int. Cl.

| | |
|---|---|
| ***G03G 21/00*** | (2006.01) |
| ***B65H 37/00*** | (2006.01) |
| ***B65H 1/28*** | (2006.01) |
| ***G03G 15/00*** | (2006.01) |

(52) U.S. Cl.

CPC ..... *B65H 37/00* (2013.01); *B65H 1/28* (2013.01); *G03G 15/6511* (2013.01); *G03G 15/6558* (2013.01); *G03G 21/00* (2013.01); *G03G 21/0005* (2013.01); *G03G 2215/00679* (2013.01); *G03G 2215/00708* (2013.01)

(58) Field of Classification Search

CPC ..... B65H 37/00; B65H 1/28; G03G 21/0005
USPC ..... 399/98
See application file for complete search history.

(56) References Cited

U.S. PATENT DOCUMENTS

| | | | | |
|---|---|---|---|---|
| 6,505,019 | B2 * | 1/2003 | Sato et al. | 399/98 |
| 6,708,009 | B2 | 3/2004 | Fuwazaki et al. | |
| 7,634,205 | B2 | 12/2009 | Jen | |
| 7,929,872 | B2 * | 4/2011 | Gross et al. | |
| 2005/0019073 | A1 * | 1/2005 | Hattori | |
| 2005/0258590 | A1 * | 11/2005 | Nishimura | |
| 2006/0222426 | A1 | 10/2006 | Jen | |
| 2007/0231032 | A1 * | 10/2007 | Matsuno | |
| 2008/0220355 | A1 * | 9/2008 | Kamoi et al. | G03G 5/14708 |
| 2011/0204557 | A1 * | 8/2011 | Ishikawa et al. | |

FOREIGN PATENT DOCUMENTS

JP 03128831 A * 5/1991

* cited by examiner

*Primary Examiner* — Susan Lee

(57) ABSTRACT

A method and apparatus for removing excess paper dust from paper fed from a high capacity feeder module that includes blades positioned after an exit of the high capacity feeder module that are configured to physically remove paper dust from sheets generated during feeding of the sheets by a fully active retard feeder from the high capacity feeder module.

11 Claims, 2 Drawing Sheets

PAPER DUST REMOVAL DEVICE

The present disclosure relates to printing machines that include multiple high capacity sheet feeders (HCF), and more particularly, to a method and apparatus for removing excessive paper dust from paper generated during operation of the printers.

Due to the aggressive nature of the fully active retard (FAR) feeder mechanism, which is fitted within the HCF module, a large amount of paper dust is created which gets transferred by the sheets into other areas of the printing device including covers, sheet take-away rolls and registration sensors causing intermittent edge detection. The dust has been found to be centralized in line with feed rolls of the FAR feeder. Also, excess paper dust drops into paper feed module (PFM) paper trays and exit guides and falls onto the PFM feed assembly, which is situated above the HCF module. This is believed to contribute towards the PFM multi-feed rate.

Heretofore, various dust removal methods have been employed. For example, US Patent Publication No. 2006/0222426 A1 discloses a sheet feeder with an electrostatic dust-collecting function that includes a paper path, a feeding roller, a dust-collecting passageway and an electrostatic charge generator. The feeding roller located on the paper path feeds a sheet through the paper path. The dust-collecting passageway has an inlet connected to the paper path and an outlet located opposite to the inlet. The electrostatic charge generator disposed aside the outlet of the dust-collecting passageway generates electrostatic charges to attract dust coming from the sheet through the dust-collecting passageway and the paper path.

U.S. Pat. No. 6,708,009 discloses a printing apparatus capable of removing dust. The printing apparatus includes a dust collecting box for collecting the dust and a sponge for scratching paper flakes and particles from a roller. The paper flakes and particles are separated from a paper path due to gravity. The size of the dust collecting box has to be increased if one desires to prevent paper flakes and particles from being blown back into the paper path due to the air stream caused by the roller rotating at a high speed.

A sheet feeder with an electrostatic dust-collecting function is shown in U.S. Pat. No. 7,634,205 B2 that includes a paper path, a feeding roller, dust-collecting passageway, an electrostatic charge generator and a dust-collecting box. The feeding roller located on the paper path feeds a sheet through the paper path. The dust-collecting passageway has an inlet connected to the paper path and an outlet located opposite to the inlet. The electrostatic charge generator disposed at the outlet of the dust-collecting passageway generates electrostatic charges to attract dust coming from sheets conveyed through the dust collecting passageway and the paper path. The dust-collecting box for collecting the dust is disposed at the outlet of the dust-collecting passageway and has an adhesive layer for adhering the dust.

All of the heretofore cited patents are included herein by reference to the extent necessary to practice the present disclosure.

Unfortunately, even though the dust removal techniques of the above prior art are useful, there is still a need to remove dust from paper conveyed within paper feeder modules.

BRIEF SUMMARY

In answer to that need, provided hereinafter is a method and apparatus for removing excess paper dust from paper sheets fed from a high capacity feeder that comprises the addition of blades, which preferably are made of plastic, positioned after the exit of the high capacity feeder module, that are adapted to physically remove excessive paper dust generated during feeding of the sheets from the FAR feeders.

The term 'sheet' herein refers to any flimsy physical sheet or paper, plastic, media, or other useable physical substrate for printing images thereon, whether precut or initially web fed.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

In a typical electrophotographic printing process, a photoconductive member is charged to a substantially uniform potential so as to sensitize the surface thereof. The charged portion of the photoconductive member is exposed to a digitized or light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

Figure 1:
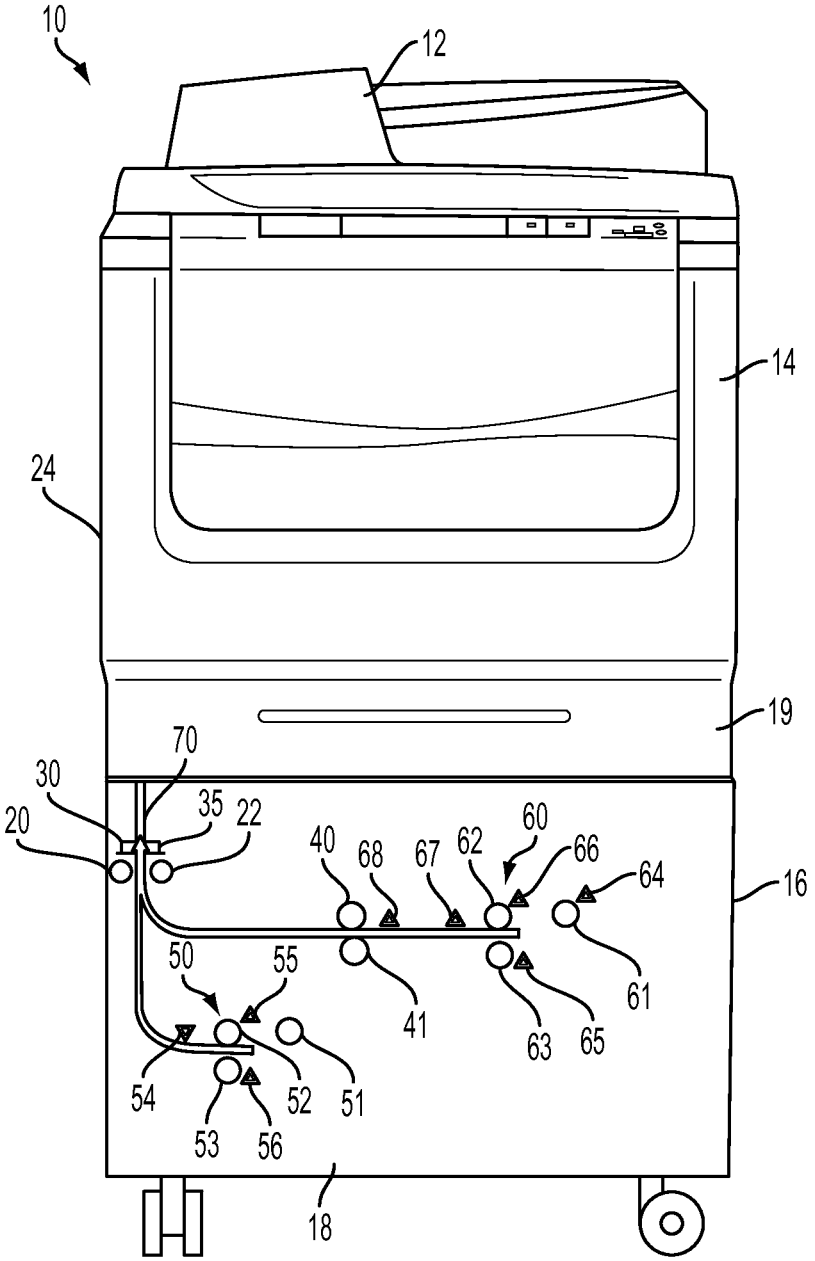
FIG. 1 is a partial, frontal view of an exemplary modular xerographic printer that includes the improved dust removing method and apparatus of the present disclosure.

Referring now to printer 10 in FIG. 1, which could be, for example, a Xerox WorkCentre 5335®, an improved method and apparatus embodiment for removing dust from paper sheets exiting high capacity feed module 16 of the present disclosure is shown. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Upon receipt of images from document handler 12 or other means of image input, marking module 14 performs image processing in printer 10 while sheets are feed from high capacity feed module 16 to receive the processed images with the now imaged sheets being subsequently conveyed to a conventional output device (not shown).

In synchronism with processing of the images, a conventional registration system (not shown) receives copy sheets from high capacity feed module 16 and brings the copy sheets into contact with the images for image transfer to the copy sheets. High capacity feed module 16 includes two high capacity trays and two fully active retard feeders 50 and 60 that feed sheets through sheet feed path 70 to imaging or marking module 14. The fully active retard feeders are located within removable draws of high capacity feeder 16 and positioned behind doors (not shown). Fully active retard feeder 50 includes a nudger roll 51 that drives sheets into a nip formed between feed roll 52 and retard roll 53 that prevent multi-feeds. Sensors 54, 55 and 56 monitor sheet movement out of fully active retard feeder 50. Movement of sheets out of the FAR feeder 60 is sensed by sensors 64, 65, 66, 67 and 68. The sheets are conveyed by the feed roll 62 into a horizontal paper that includes path take-away nip (40, 41) and then into sheet path 70 and thereafter into marking module 14 through a high capacity feeder take-away nip formed between rollers 20 and 22 and subsequently through scrapers 30 and 35 that remove paper dust and debris from the top and bottom of the sheets created by the HCF/FAR system. A drawer 19 is shown that houses a paper feed module that employs semi-active retard feeder.

Figure 2:
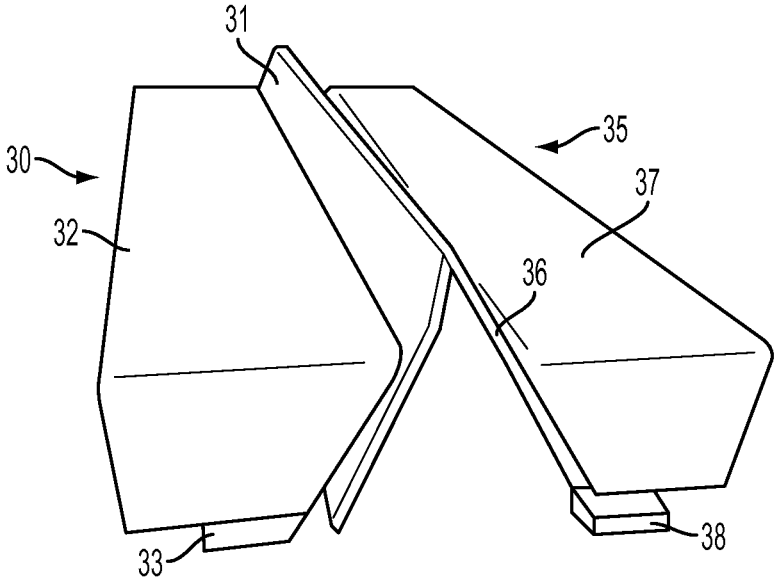
FIG. 2. Is a partial perspective view of sheet dust scrapers employed in the modular xerographic printer apparatus of FIG. 1.

With further reference to FIGS. 1 and 2, and in accordance with the present disclosure, scrapers 30 and 35 are fitted to the center of the exit of high capacity feeder module 16 to scrape dust off of the sheets that drops into a base pan or bottom of the frame of high capacity feeder module 16. Scraper 30 comprises a blade 31 attached to a plastic member 32 that is mounted on support member 33. Support structure 33 includes a clip at one end and a snap feature at an opposite end thereof that is configured to enable fitment to a frame portion of high capacity feeder module 16. Similarly, scraper 35 includes a blade 36 attached to a plastic support 37 and mounted on a support member 38. Support structure 38 also includes a clip at one end and a snap feature at the opposite end to facilitate attachment to high capacity feeder module 16. As an example blades 31 and 36 could have a thickness of about 0.36 mm.

In recapitulation, a method and apparatus is disclosed for improving the print quality of printers that includes the addition of blades at the exit of high capacity paper feeder module to physically remove unwanted dust particles from paper generated during the operation of the feed head assemblies of the fully active retard feeders. The scrapers are fitted within the HCF module, and thereby prevent the excess dust from being transferred to the paper feeder module 16 and left hand door 24 of the printing machine that is situated directly above the HCF module.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for removing dust from paper fed from a paper feeding apparatus within a printer, including:

providing a paper feeder module that includes at least one paper tray with paper therein and a feed head and an exit portion of said paper feeder module for guiding paper exiting said paper feeder module;

providing flexible members such that paper exiting said at least one paper tray are simultaneously contacted by said flexible members, and wherein said flexible members have a thickness of about 0.36 mm;

initiating feeding of paper from said at least one paper tray into a predetermined paper path for a print job; and scraping upper and lower surfaces of each paper sheet fed from said at least one paper tray with said flexible members to remove dust therefrom.

2. The method of claim 1, including said flexible members are made of plastic.

3. The method of claim 2, including providing multiple paper trays and feed heads within said paper feeder module.

4. The method of claim 1, providing said paper feeder module with a base portion and catching said dust removed from paper sheets by said flexible members in said base portion of said paper feeder module.

5. The method of claim 1, including fitting said flexible members to a center portion of said exit of said paper feeder module.

6. The method of claim 1, including attaching said flexible members to plastic members.

7. A reprographic apparatus includes a device for removing dust from sheets conveyed therein, comprising:

a marking module;

a sheet feeder module;

at least one feed head for feeding sheets through an exit portion of said sheet feeder module towards said marking module; and flexible members attached to a center portion of an exit portion of said sheet feeder module and positioned to remove dust from upper and lower surfaces of sheets fed by said at least one feed head, and wherein said flexible members include at least two blades made of plastic with said plastic blades having a thickness of about 0.36 mm.

8. The reprographic device of claim 7, wherein said at least one feed head is a fully active retard feed head that is fitted within a high capacity sheet feeder module.

9. The reprographic device of claim 8, wherein said high capacity sheet feeder module includes multiple sensors to sense sheet movement therein.

10. The reprographic device of claim 9, wherein said high capacity sheet feeder module includes multiple feed heads.

11. A method for removing dust from paper sheets as they enter a predetermined paper path within a printing apparatus, including:

providing multiple trays with paper sheets therein within a paper feeder module;

selecting one of said multiple trays for a print job;

providing said paper feeder module with a feed head and initiating feeding of sheets from said selected one of said multiple trays into said predetermined paper path by said feed head; and scraping paper dust from upper and lower surfaces of each sheet feed from said selected one of said multiple trays with scrapers in the form of plastic blades having a thickness of about 0.36 mm and positioned within said predetermined paper path above and below an exit of said paper feeder module.

* * * * *